US005496015A

United States Patent [19]

Carmien

[11] Patent Number: 5,496,015

[45] Date of Patent: Mar. 5, 1996

[54] ROOFER'S RIPPING SPADE

[76] Inventor: Joseph A. Carmien, 525 N. Maple Dr., Beverly Hills, Calif. 90210

[21] Appl. No.: 342,384

[22] Filed: Nov. 18, 1994

[51] Int. Cl.[6] ..... A47L 13/02; B25G 3/34

[52] U.S. Cl. ..... 254/131.5; 294/49; 294/57

[58] Field of Search ..... 294/49, 55, 55.5, 294/57, 59; 30/169, 171, 172; 16/110 R; 76/113; 81/45; 254/131.5; 403/265, 268, 292, 314, 334

[56] References Cited

U.S. PATENT DOCUMENTS

| | | | |
|---|---|---|---|
| Re. 32,364 | 2/1987 | Carmien . | |
| 657,422 | 9/1900 | Judd . | |
| 1,374,336 | 4/1921 | Surbaugh . | |
| 1,755,236 | 4/1930 | Brandenburg . | |
| 2,031,556 | 2/1936 | Brandenburg . | |
| 2,063,774 | 12/1936 | Washington . | |
| 2,238,104 | 4/1941 | Finley . | |
| 3,113,758 | 12/1963 | Knowles | 254/131.5 |
| 3,549,189 | 12/1970 | Alosi . | |
| 4,050,727 | 9/1977 | Bonnes . | |
| 4,086,699 | 5/1978 | Olkkola | 294/49 X |
| 4,451,073 | 5/1984 | Carmien . | |
| 4,477,972 | 10/1984 | Testa | 294/49 X |
| 4,570,988 | 2/1986 | Carmien . | |
| 4,605,254 | 8/1986 | Carmien . | |
| 4,639,029 | 1/1987 | Kolonia | 294/57 |
| 5,280,676 | 1/1994 | Fieni | 81/45 X |
| 5,310,230 | 5/1994 | Carmien . | |

FOREIGN PATENT DOCUMENTS

| | | |
|---|---|---|
| 1376180 | 12/1974 | United Kingdom . |

*Primary Examiner*—Johnny D. Cherry
*Attorney, Agent, or Firm*—Kelly, Bauersfeld & Lowry

[57] ABSTRACT

A roofer's ripping spade is fabricated by inserting an end of a tool handle into a handle receiving socket of a tool head having a blade and a back-side cavity in the blade. A molded composite block including a fulcrum portion and a frog portion is positioned adjacent to a lower surface of the blade such that the fulcrum portion extends away from a lower surface of the blade and the frog portion is situated within and configured to fill the back-side cavity. Attachment rivets extend through aligned apertures in the fulcrum portion of the composite block and the blade to fasten the composite block to the blade. A tang element has a first end secured to the frog portion of the composite block, and a second end secured to the tool handle, to interconnect the frog portion of the composite block with the end of the tool handle inserted into the handle receiving socket of the tool head.

17 Claims, 2 Drawing Sheets

FIG. 4
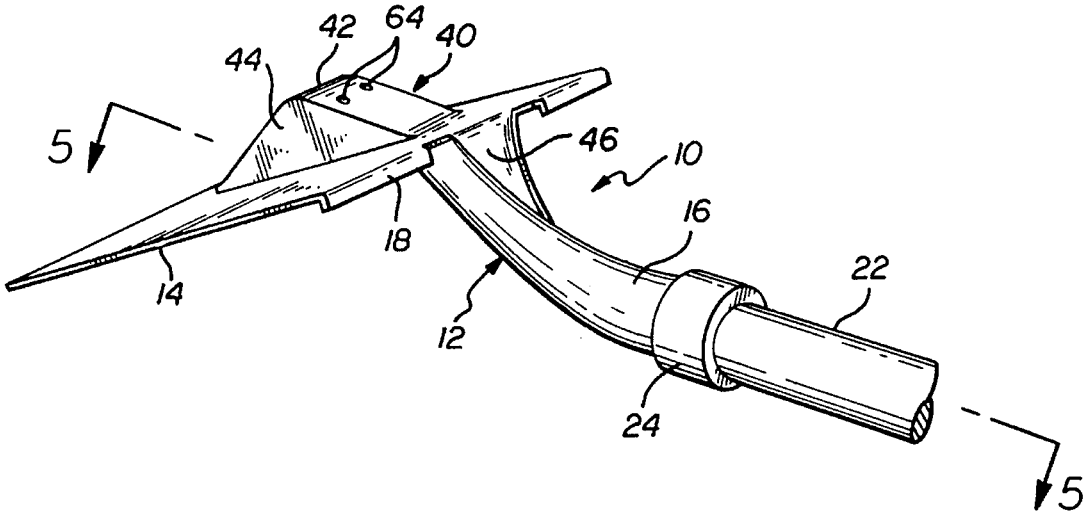
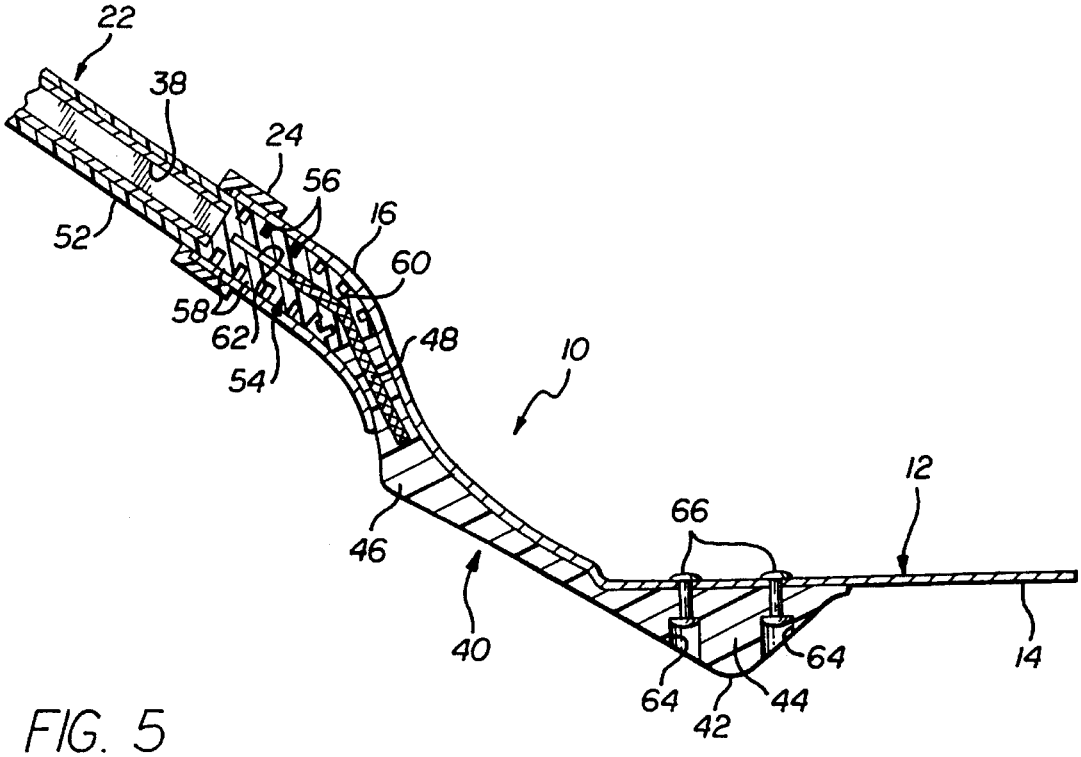
FIG. 5

ROOFER' S RIPPING SPADE

BACKGROUND OF THE INVENTION

This invention relates generally to hand tools. More specifically, the present invention relates to a roofer's ripping spade or a shingle stripping shovel that is provided a fulcrum below the blade of the tool head without requiring welding or like processes which tend to weaken the blade.

Traditionally, the spade or shovel which has been used to strip shingles from an old roof has utilized a tool head having a relatively flat blade that has a piece of "V"-shaped steel strapping welded to its back-side or lower surface. The steel strapping provides a fulcrum for the tool head which facilitates the prying off of old shingles from the roof.

The primary shortcoming of this standard design for roofer's ripping spades or shingle stripping shovels is that when the piece of V-shaped steel strapping is welded in place, the spot welding degrades the shovel blade. Often one or more of the spot welds will break and the strapping will be lost or the tool will be rendered useless for its intended purpose. Additionally, the process of welding steel strapping to the lower surface of the blade increases the cost of manufacturing the roofer's ripping spade because, and in addition to the cost and weight of the steel strapping material itself, there are additional costs incurred in connection with the welding process, slag cleaning, and further re-heat treating or annealing the shovel blade to eliminate brittle spots caused by the welding process.

Accordingly, there has been a need for a roofer's ripping spade that may be manufactured utilizing improved materials and processes, which overcomes the drawbacks noted above, utilizes composite tool handles for increased strength and longevity of the tool itself, and which may be manufactured efficiently and at lower cost than prior ripping spades and shingle stripping shovels. In particular, a novel roofer's ripping spade is needed which eliminates the welding of V-shaped steel strapping to a lower surface of the blade, and the increased manufacturing costs associated therewith. The present invention fulfills these needs and provides other related advantages.

SUMMARY OF THE INVENTION

The present invention resides in a novel roofer's ripping spade that utilizes a composite tool handle which is inserted into a handle receiving socket of a tool head having a blade and a back-side cavity in the blade. A molded composite block underlies and is positioned adjacent to a lower surface of the blade. The composite block includes a fulcrum portion which extends away from the lower surface of the blade and which serves the same purpose as the V-shaped steel strapping typically welded to the blade in such tools. Means are provided for attaching the fulcrum portion of the composite block to the blade, and for interconnecting the composite block with the tool handle.

In a preferred form of the invention, a standard open-back tool head is utilized which includes a blade, a back-side cavity in the blade, and a handle receiving socket. A composite tool handle is utilized which has an end adapted for insertion into the handle receiving socket of the tool head. The inserted end of the tool handle includes a thermoplastic section having a flexible core comprising a generally cylindrical body, at least one groove in the body which forms at least one socket filler for bearing a compressive load in the handle receiving socket, and a flexible shaft capable of bending to permit the core to conform to the shape of the handle receiving socket. An elongate tang receiving channel is also provided in a terminal end of the flexible core.

The molded composite block is preferably an integral component which includes the fulcrum portion and a frog portion situated within and configured to fill the back-side cavity of the blade. The flexible core of the tool handle and the frog portion of the composite block cooperatively substantially fill the handle receiving socket.

The means for attaching the fulcrum portion of the composite block to the blade includes aligned apertures through the fulcrum portion and the blade, and means extending though said apertures for fastening the fulcrum portion of the composite block to the blade. The fastening means comprises attachment rivets.

The means for interconnecting the composite block with the end of the tool handle inserted into the handle receiving socket of the tool head, includes a tang element having a first end secured to the frog portion of the composite block, and a second end which is driven into the elongate tang receiving channel. The tang element has cross-sectional dimensions greater than the cross-sectional dimensions of the elongate tang receiving channel. Further, the tang element includes surface irregularities which inhibit removal of the tang element from the tang receiving channel.

The tang element is preferably pre-secured to the frog portion of the composite block, and is then heated within a heating block to a temperature within the range of 300° F. to 500° F. The frog portion is then positioned within the back-side cavity of the blade, such that the tang element extends rearwardly into the handle receiving socket. The elongate tang receiving channel within the thermoplastic section of the composite tool handle is aligned with the tang element by simply placing the inserted end of the tool handle into the handle receiving socket of the tool head. A high strength compression collar or ring may be mounted at the mouth of the handle receiving socket to preclude the socket from opening under applied loads. When the tool handle is so positioned, the heated tang element may be driven into the tang receiving channel such that as the tang element engages the tool handle, the thermoplastic section surrounding the tang receiving channel is softened and flows into intimate contact around the tang element and then hardens as the heat of the tang element is dissipated.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 4 is a perspective view of a roofer's ripping spade embodying the present invention, wherein a composite tool handle is assembled to a tool head having a back-side cavity, and the composite block/tang element assembly of FIGS. 2 and 3 is positioned such that a fulcrum portion of the composite block extends away from a lower surface of the blade, and a frog portion of the composite block is situated within and configured to fill the back-side cavity of the blade; and FIG. 5 is an enlarged sectional view taken generally along the line 5—5 of FIG. 4, wherein surface irregularities on the tang element comprise diamond knurling.

DETAILED DESCRIPTION OF THE PREFERRED EMBODIMENT

Figure 1:
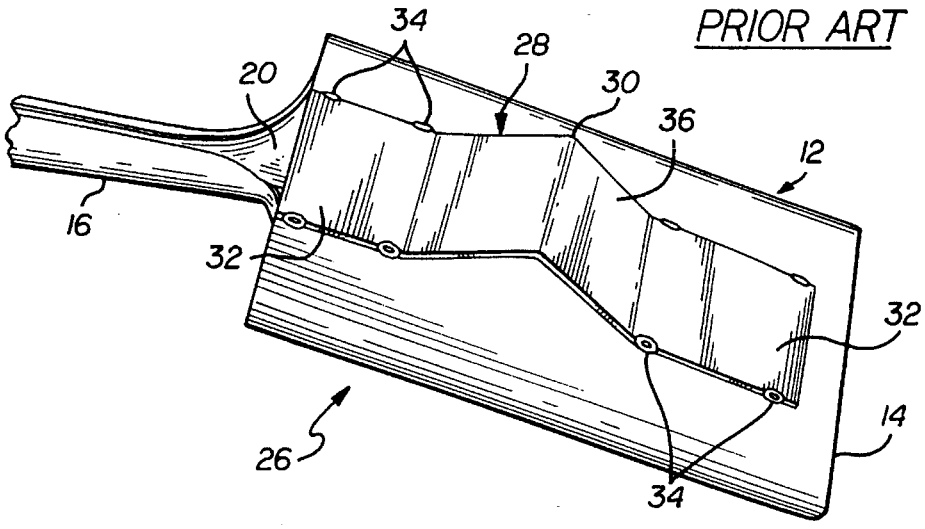
FIG. 1 PRIOR ART
FIG. 1 is a perspective view of a traditional roofer's ripping spade having V-shaped steel strapping welded to a lower surface of a blade to provide a steel fulcrum for the tool head.

As shown in the drawings for purposes of illustration, the present invention is concerned with a roofer's ripping spade, generally designated by the reference number 10. The spade 10 comprises, generally, a tool head 12 including a blade 14, an integral handle receiving socket 16 and a foot tread 18. The tool head 12 is typically forged or stamped from a single sheet metal blank and formed into the desired configuration by well-known stamping and forming procedures. In order to provide appropriate stiffness for the blade 14 relative to the handle receiving socket 16, a back-side cavity 20 adjacent to the socket 16 is usually formed. The handle receiving socket 16 is dimensioned to receive a composite tool handle 22. To preclude the socket 16 from opening under applied loads, a high strength compression collar 24 may be mounted at the mouth of the socket.

FIG. 1 illustrates a prior art tool head 12 for a shingle stripping shovel 26. As mentioned previously, such prior shovels 26 traditionally have welded to the lower surface of the blade 14 a piece of V-shaped steel strapping 28 which provides a fulcrum 30 by which an operator obtains leverage to pry off old shingles from a roof. The steel strapping 28 comprises a pair of support plates 32 secured to the blade 14 by spot welds 34. A V-shaped fulcrum plate 36 is formed integrally with the support plates 32 to position the fulcrum 30 at a defined distance from the lower surface 35 of the blade 14. Either traditional wood handles or composite tool handles may be inserted into the handle receiving socket 16 of the tool head 12 in such prior art shingle stripping shovels 26.

Turning now to the present invention, as illustrated and described in U.S. Pat. Nos. 4,570,988 and 4,605,254 (the contents of which are incorporated herein), the composite tool handle 22 is manufactured by drawing a fiber material through a resin bath into a die tube where the fibers are heated and cured by a heating element surrounding the die tube. The cured rod is pulled out of the die tube by tractor-type pullers and cut to the desired length by a conventional cutting device. As the fibers enter the die tube, alternating sections of lightweight tubing and reinforcing core are inserted into the center of the die tube and are simultaneously surrounded by the fibers and drawn into and through the die tube. By this method a continuous hollow fiberglass rod 38 can be quickly and easily manufactured with a reinforced section integrally included at any desired location.

In accordance with the present invention and as illustrated in FIGS. 2–5, a molded, integral, composite block 40 is provided which substantially fills the back-side cavity 20 of the tool head 12, and which provides a fulcrum 42 spaced from a back-side of the blade 14 by which an operator can leverage the spade 10 to pry off old shingles from a roof. The composite block 40 is configured to underlie the lower surface of the blade 14, and includes a fulcrum portion 44 which extends away from the lower surface of the blade, and a frog portion 46 which is situated within and configured to fill the back-side cavity 20 of the blade.

Figure 3:
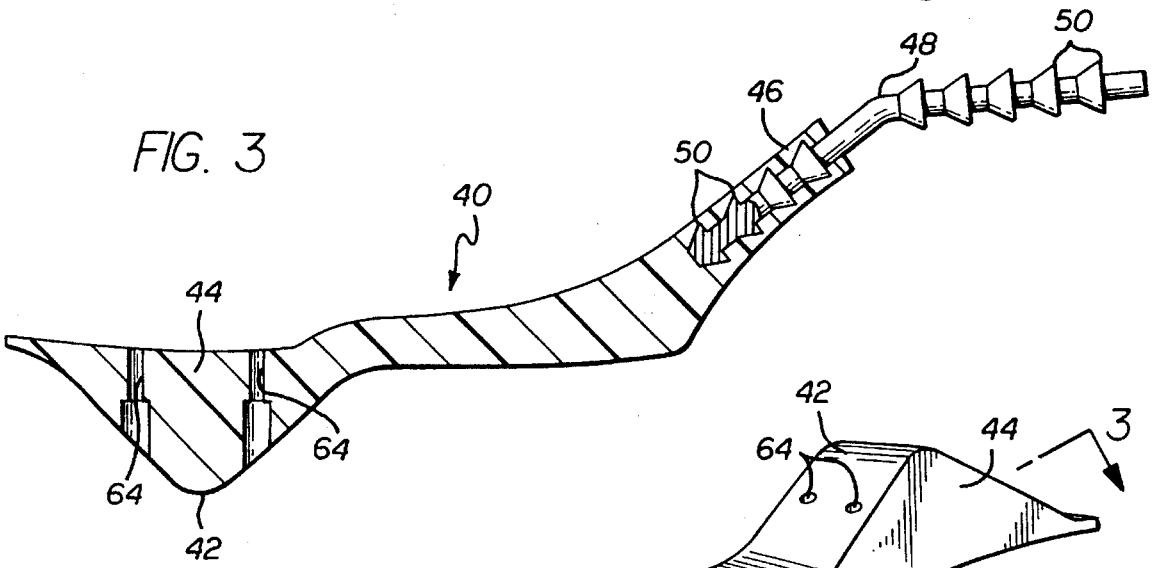
FIG. 3 is an enlarged partially sectional view taken generally along the line 3—3 of FIG. 2.
Figure 2:
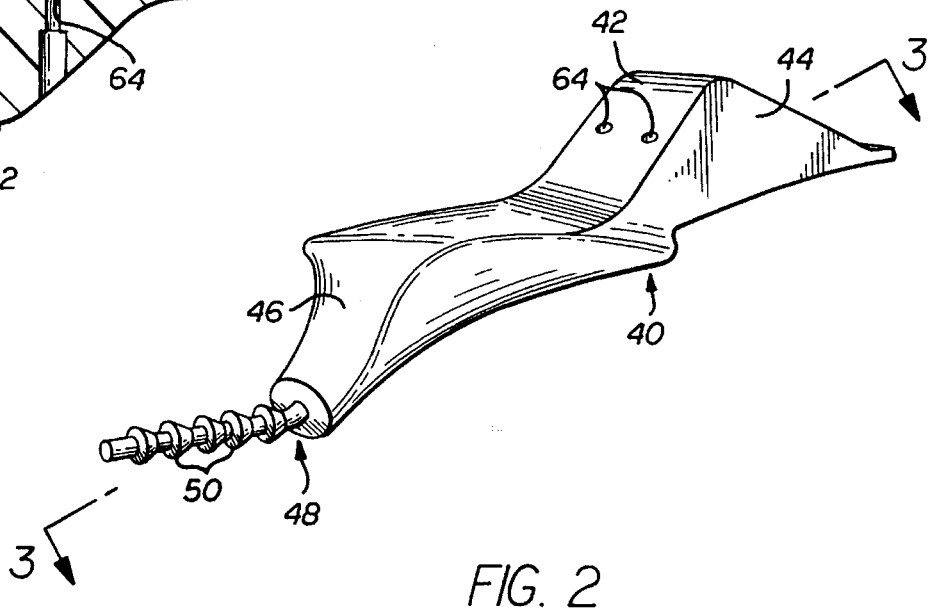
FIG. 2 is a bottom and side perspective view of a composite block and tang element assembly utilized in connection with the roofer's ripping spade of the present invention.

A tang element 48 having surface irregularities 50 is secured within the frog portion 46 of the composite block 40 and positioned so as to extend generally centrally into the handle receiving socket 16 of the tool head 12. The tang element 48, which may have a non-circular cross-section, may be fixed within the frog portion 46 as an insert when the composite block 40 is molded, or may be heated and driven into the frog portion in a manner similar to the process described below. The surface irregularities 50 preferably have any configuration design to inhibit removal of the tang element from the frog portion 46 and the composite tool handle 22. Such surface irregularities may take the form of diamond knurling as illustrated in FIG. 5, or may include bumps or ridges as illustrated in FIGS. 2 and 3.

As shown best in FIGS. 5, the composite tool handle 22 includes a thermoplastic jacket 52 which surrounds the fiberglass rod 38. The inserted end of the tool handle 22 comprises a flexible core 54 formed by the thermoplastic material of the jacket 52. The flexible core 54 fits within the handle receiving socket 16 of the tool head 12 to minimize the possibility of the socket buckling or collapsing under high bending stresses, and is similar to the flexible core illustrated in U.S. Pat. No. Re. 32,364 (the contents of which are incorporated herein).

More particularly, the flexible core 54 is intended to provide compressive support for the portion of the handle receiving socket 16 which would normally be empty following assembly of the spade 10. To provide for flexibility, a series of grooves 56 are formed around the periphery of the core and spaced from each other along the length of the core to form a series of socket fillers 58 which serve to support the handle receiving socket 16. The peripheral grooves 56 define a central shaft 60 running continuously along the axis of the core 54, and the shaft 60 is flexible enough to bend and conform to the configuration of the handle receiving socket 16.

The process for assembling the roofer's ripping spade 10 in accordance with the present invention comprises the steps of heating the tang element 48, placing the composite block 40 adjacent to the blade 14 such that the frog portion 46 and the tang element are inserted into the back-side cavity 20 of the tool head 12 so that the tang element extends into the handle receiving socket 16, aligning a front end of the composite tool handle 22 with the rewardly extending tang element, and driving the heated tang element into the flexible core 54. The utilization of a thermoplastic material, such as polystyrene, for the flexible core facilitates an attachment between the tang element and the flexible core whereby as the heated tang element engages the tool handle, the thermoplastic flexible core is softened to permit entry of the tang element. The thermoplastic material flows into intimate contact around the tang element 48 and then hardens as the heat of the tang element 48 is dissipated, to hold the tang element in place.

More particularly, an elongate tang receiving channel 62 is provided along the longitudinal axis of the shaft 60 of the flexible core 54. The tang receiving channel 62 preferably has cross-sectional dimensions which are less than the cross-sectional dimensions of the tang element 48. This insures at least a minimal level of interference between the thermoplastic flexible core 54 and the heated tang element 48 when the tang element is driven into the tool handle 22.

This interference is typically within the range of 0.015 inch to 0.025 inch, and ideally about 0.020 inch.

The tang element 48 is heated to a temperature within the range of 300° F. to 500° F. in a heating block. When so heated, the frog portion 46 of the composite block 40 and the tang element 48 are then positioned within the back-side cavity 20 of the handle receiving socket 16 of the tool head 12. The subassembly of the composite block 40, the tang element 48 and the tool head 12 is placed within a suitable jig. The composite tool handle 22 is then aligned with the tool head 12 so that the flexible core 54 is placed within the handle receiving socket 16. The tool handle 22 is driven into the socket 16 so that the tang element 48 is forced into the tang receiving channel 62 in the flexible core 54, to interconnect the frog portion 46 of the composite block 40 and the composite tool handle 22, in a manner similar to that shown in U.S. Pat. No. 5,310,230 (the contents of which are incorporated herein).

Aligned apertures 64 are provided through the fulcrum portion 44 of the composite block 40 and the blade 14. Attachment rivets 66 are secured through these apertures 64 to fasten the fulcrum portion 44 to the tool head 12.

From the foregoing it is to be appreciated that the roofer's ripping spade 10 described above eliminates the steel strapping 28 which is spot welded to the blade 14 of prior art shingle stripping shovels 26, and replaces that structure with a more appropriately conformed block of molded engineering plastic which not only provides the fulcrum 42 from which leverage can be created, but also fills the back-side cavity 20 in the tool head 12, thus reinforcing the blade 14. The composite block 40 may be molded so that the minimum amount of material is actually used while insuring adequate strength, through appropriate coring. The use of rivets 66 to fasten the fulcrum portion 44 of the composite block 40 to the blade 14 does not anneal the surrounding steel of the blade as occurs with spot welding. Inasmuch as the rivets 66 can be removed, should there ever be the need for a replacement composite block 40, it is matter of very simple mechanical aptitude to remove the old block 40 and mount a new one by riveting it to the blade 14 with ordinary hand tools.

Although a particular embodiment of the invention has been described in detail for purposes of illustration, various modifications may be made without departing from the spirit and scope of the invention. Accordingly, the invention is not to be limited, except as by the appended claims.

I claim:

1. A roofer's ripping spade, comprising:

a tool head including a blade, a back-side cavity in the blade, and a handle receiving socket extending from the blade;

a tool handle having an end inserted into the handle receiving socket of the tool head;

a molded composite block underlying and positioned adjacent to a lower surface of the blade, the composite block including a fulcrum portion extending away from the lower surface of the blade, and a frog portion situated within and configured to fill the back-side cavity of the blade;

means for attaching the fulcrum portion of the composite block to the blade; and means for interconnecting the frog portion of the composite block with the end of the tool handle inserted into the handle receiving socket of the tool head.

2. The spade of claim 1, wherein the interconnecting means includes a tang element having a first end secured to the frog portion of the composite block, and a second end secured to the tool handle.

3. The spade of claim 2, wherein the inserted end of the tool handle includes a thermoplastic section having an elongate tang receiving channel into which the second end of the tang element is driven.

4. The spade of claim 3, wherein the tang element has cross-sectional dimensions greater than the cross-sectional dimensions of the elongate tang receiving channel.

5. The spade of claim 4, wherein the tang element includes surface irregularities to inhibit removal of the tang element from the tang receiving channel.

6. The spade of claim 3, wherein the thermoplastic section of the tool handle includes a flexible core which, with the frog portion of the composite block, substantially fills the handle receiving socket of the tool head, wherein the flexible core includes an elongated, generally cylindrical body, at least one groove formed in said body forming at least one socket filler for bearing a compressive load in the handle receiving socket, and a flexible shaft capable of bending to permit the core to conform to the shape of the handle receiving socket.

7. The spade of claim 1, wherein the attaching means includes aligned apertures through the fulcrum portion and the blade, and means extending through said apertures for fastening the fulcrum portion of the composite block to the blade.

8. The spade of claim 7, wherein the fastening means comprises attachment rivets.

9. A roofer's ripping spade, comprising:

a tool head including a blade, a back-side cavity in the blade, and a handle receiving socket extending from the blade;

a composite tool handle having an end inserted into the handle receiving socket of the tool head, the inserted end including a thermoplastic section;

a molded, integral, composite block underlying and positioned adjacent to a lower surface of the blade, the composite block including a fulcrum portion extending away from the lower surface of the blade;

means for mechanically attaching the block, through the fulcrum portion, to the blade; and a tang having a first end secured to the composite block, and a second end secured to the end of the tool handle inserted into the handle receiving socket, wherein the tang interconnects the composite block and the inserted end of the tool handle within the handle receiving socket.

10. The spade of claim 9, wherein at least a portion of the composite block comprises a thermoplastic material, and wherein the second end of the tang is secured within the thermoplastic section of the tool handle, and the first end of the tang is secured within the thermoplastic portion of the composite block.

11. The spade of claim 10, wherein the tang includes surface irregularities to inhibit removal of the tang from the thermoplastic section of the tool handle and the thermoplastic portion of the composite block.

12. The spade of claim 9, wherein the thermoplastic section of the tool handle includes a flexible core which substantially fills the handle receiving socket.

13. The spade of claim 12, wherein the flexible core includes an elongated, generally cylindrical body, at least one groove formed in said body forming at least one socket filler for bearing a compressive load in the handle receiving socket, and a flexible shaft capable of bending to permit the core to conform to the shape of the handle receiving socket.

14. The spade of claim 9, wherein the composite block includes a frog portion situated within and configured to fill the back-side cavity of the blade, the frog portion including the thermoplastic portion of the composite block.

15. The spade of claim 14, wherein the frog portion extends from the back-side cavity into the handle receiving socket of the shovel head.

16. The spade of claim 9, wherein the attaching means includes aligned apertures through the fulcrum portion and the blade, and attachment rivets extending through said apertures for fastening the fulcrum portion of the composite block to the blade.

17. A roofer's ripping spade, comprising:

a tool head including a blade, a back-side cavity in the blade, and a receiving socket extending from the blade;

a tool handle having an end inserted into the handle receiving socket of the tool head, the inserted end including a thermoplastic section including a flexible core comprising an elongated, generally cylindrical body, at least one groove formed in said body forming at least one socket filler for bearing a compressive load in the handle receiving socket, a flexible shaft capable of bending to permit the core to conform to the shape of the handle receiving socket, and an elongate tang receiving channel;

a molded, integral, composite block underlying and positioned adjacent to a lower surface of the blade, the composite block including a fulcrum portion extending away from the lower surface of the blade, and a frog portion situated within and configured to fill the back-side cavity of the blade;

means for attaching the fulcrum portion of the composite block to the blade, including aligned apertures through the fulcrum portion and the blade, and attachment rivets extending through said apertures for fastening the fulcrum portion of the composite block to the blade; and means for interconnecting the frog portion of the composite block with the end of the tool handle inserted into the handle receiving socket of the tool head, wherein the interconnecting means includes a tang element having a first end secured to the frog portion of the composite block, and a second end secured within the elongate tang receiving channel of the thermoplastic section of the tool handle, the tang element having cross-sectional dimensions greater than the cross-sectional dimensions of the elongated tang receiving channel, and wherein the tang element includes surface irregularities to inhibit removal of the tang element form the tang receiving channel.

* * * * *